United States Patent [19]

Schmitt et al.

[11] 4,036,684

[45] July 19, 1977

[54] HIGH BULK TISSUE FORMING AND DRYING APPARATUS

[75] Inventors: Arnold J. Schmitt; Merle G. Linkletter, both of Beloit, Wis.

[73] Assignee: Beloit Corporation, Beloit, Wis.

[21] Appl. No.: 601,521

[22] Filed: Aug. 4, 1975

[51] Int. Cl.[2] ..... D21F 5/04; D21F 5/18

[52] U.S. Cl. ..... 162/290; 34/115; 34/116; 34/159; 162/301; 162/306

[58] Field of Search ..... 162/281, 283, 290, 301, 162/306, 359, 207; 34/115, 116, 155, 159

[56] References Cited

U.S. PATENT DOCUMENTS

| | | | |
|---|---|---|---|
| 2,537,129 | 1/1951 | Goodwillie | 162/290 |
| 3,303,576 | 2/1967 | Sisson | 34/115 |
| 3,560,333 | 2/1971 | Douglas et al. | 162/281 X |
| 3,694,311 | 9/1972 | Skeppstedt | 162/290 |
| 3,812,000 | 5/1974 | Salvucci, Jr.; et al. | 162/281 X |
| 3,839,143 | 10/1974 | Sackow | 162/301 X |
| 3,874,997 | 4/1975 | Kankaanpaa | 162/290 |
| 3,891,500 | 6/1975 | Kankaanpaa | 162/290 X |

*Primary Examiner*—S. Leon Bashore
*Assistant Examiner*—Richard V. Fisher
*Attorney, Agent, or Firm*—Dirk J. Veneman; Michael L. Gill; Gerald A. Mathews

[57] ABSTRACT

A web pickup and drying apparatus in a papermaking machine for producing a high bulk paper tissue web while carrying the web throughout its travel from pickup off the forming wire through the drying stages on the surface of a fabric, felt or dryer roll. After pickup, the web is first subjected to a thru-air (transpiration) dryer from which it is applied to the surface of a large diameter dryer roll. There is no conventional press section to reduce bulk before the web is dry.

4 Claims, 1 Drawing Figure

HIGH BULK TISSUE FORMING AND DRYING APPARATUS

BACKGROUND OF THE INVENTION

This invention relates to the control of the delicate tissue paper web during its production and, more particularly, to the control of the conveyance of high bulk paper tissue of the type commonly used as facial and toilet tissue. Still more particularly, it relates to a pickup and drying arrangement for preserving and enhancing the high bulk properties, which are initially a part of a tissue web but which are usually lost or diminished during its passage through a papermaking machine, all the while controlling the conveyance of the web.

Illustrations of prior types of high bulk tissue, processes and machines for its manufacture are shown in U.S. Pat. Nos. 3,301,746 and 3,812,000. The apparatus disclosed in these patents for manufacturing such tissue have one common deficiency in their structural configurations. Specifically, at some point during the conveyance of the tissue web from its formation until it is removed from the last dryer, it is not carried by a felt, fabric or dryer roll surface. By "not carried," it is meant that the web, at some point along its path of travel, is either totally unsupported or must adhere to the bottom of the felt, fabric or dryer surface from which it can drop off or be temporarily separated from the felt, fabric or dryer surface. This is a situation which usually occurs between successive rolls along the web's serpentine path of travel in the papermaking machine.

Web support, and positive control of its movement, is important in the manufacture of all types of paper, but it is especially critical in the manufacture of tissue paper grades because of the comparatively high speeds involved (commonly about 3,000 fpm, but often up to about 4,000 fpm and, sometimes, over 5,000 fpm) and the relatively light weight of the tissue web itself (about 12–15 lbs. per 3,000 $ft^2$). By contrast, a typical newsprint machine for example might run about 2,000 fpm with a web basis weight of about 32 lbs. per 3,000 $ft^2$.

If the sheet is not supported and controlled during its manufacture, it might break or billow away from its carrier surface and become wrinkled as it passes through a roll nip or over a roll beneath the felt or fabric. Any such interruption in the papermaking process is very disruptive and expensive in terms of lost time. In addition, any wrinkled paper must be rejected and recycled.

The production of high bulk tissue is especially sensitive to web control since there is no press section in the papermachine configuration to compress the tissue web and thus tend to increase its stability and ease in handling.

SUMMARY OF THE INVENTION

This invention provides maximum web stability by carrying the web on top of the fabric or dryer surface from the point where it is removed from the forming wire to the point where it is doctored off the last drying roll to be wound on the reel. The web is never passed across an open gap or adhered to the bottom of a fabric or dryer surface as it travels through the paper-making machine.

Accordingly, it is an object of the invention to provide a high bulk tissue papermaking machine configuration which positively controls the web during its travel through the machine.

Another object of the invention is to provide a high bulk tissue papermaking machine and configuration wherein the web is carried on a fabric, felt or dryer surface for its entire path of travel through the machine from its pickup on the forming wire through the last dryer.

A feature of the invention is a papermaking machine configuration having maximum web support and control without utilizing two separate fabrics to hold the web therebetween.

These and other objects, features and advantages of the invention will be readily apparent to those skilled in the art when the description of the preferred embodiment is read in conjunction with the attached drawing.

DESCRIPTION OF THE PREFERRED EMBODIMENT

Figure 1:
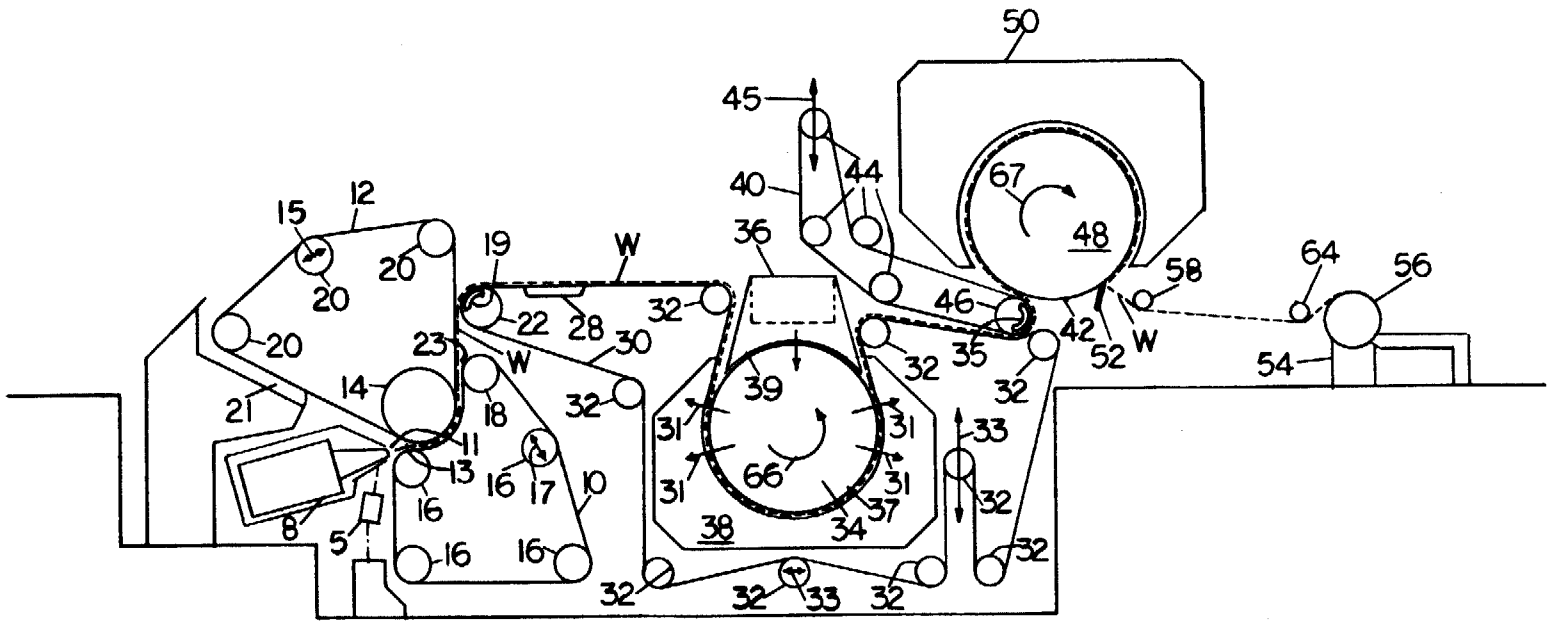
FIG. 1 is a side elevational view in somewhat schematic form, showing the preferred embodiment of the papermaking machine configuration from the stock former to the reel.

As shown in the drawing, a hydraulic former 8 is movably positioned by a jack screw 5 to discharge a dilute aqueous slurry of tissue paper stock fibers 13 through its slice 11 into the converging gap defined by upper and lower forming wires 12, 10, respectively.

Upper looped forming wire 12 is guided about its path of travel by guide rolls 20 and forming roll 14 which are mounted to cross beams which in turn are mounted to side framework (both of which are not shown for clarity, but which are well known to those in the paper industry). Similarly, lower forming wire 10 is guided about its path of travel by guide rolls 16 which are mounted to cross beams (not shown). For guiding purposes, one or more rolls 20, 16 are adjustably mounted for lateral movement indicated by double-headed arrows 15, 17. A pan 21 is positioned to receive excess water thrown from wire 12 as it travels downwardly to begin the web formation process.

The mat of stock fibers forming web W travels between forming wires 10, 12 to a point where lower wire 10 is guided away from one side by turning roll 18. Web W remains on wire 12 by virtue of a pressure differential created when a slight gap 23 is formed over one side of the web W as wire 10 is guided away from it just prior to being turned around roll 18. The atmospheric pressure between web W and top wire 12 is less than that in a gap between the web and lower wire 10. This, in combination with the surface tension of the water in the interstices of wire 12, causes web W to adhere to wire 12 from which it is picked off to be carried on fabric 30 by pickup roll 22 having a suction gland 19 therein.

A suction flat box 28 is mounted to be positioned against the inside surface of looped fabric 30 to assist in removing water from the newly formed web W. Fabric 30 is any of a variety of commercially available foraminous configurations, usually of a woven construction, which are commonly made of plastic filaments, but which can also be made of metallic wires. Such a fabric is lightweight, flexible and may contain a pattern to impart a desired surface design or texture to the web.

Fabric 30 is guided in a looped path by a plurality of guide rolls 32, one or more of which is laterally movable, as indicated by arrows 33, to adjust tension in the fabric as desired. Two of the guide rolls 32 train fabric 30 over the surface of dryer roll 34 which is of the thru-air, or transpiration, type. A transpiration dryer functions by projecting heated gas (in this case, air) through the web material (in this case, tissue paper) whereby the exposure of the web fibers to the evaporative effects of the air is increased and moisture is physically blown out and removed from the web. The dryer surface 37 is foraminous, or perforated, to distribute the heated air uniformly through the web. Typically, it is constructed of fine wire mesh. A hot air plenum 36 is mounted over a portion of the upper periphery of dryer 34 to blow hot air through its foraminous bottom wall 39, into the interior of roll 34 through its foraminous surface and out through the remainder of the peripheral roll surface to dry the web. The direction of this discharged hot air is indicated by arrows 31 as it enters a receiving plenum 38 for discharge from the machine.

Downstream, in the direction of web W travel, a transfer roll 46, having a suction chamber 35, is positioned to contact both the web W on fabric 30 and the surface of a large rotatable dryer roll drum 48 having a smooth, non-foraminous surface 42. Actually, contact is made by a second fabric 40, which may be similar to the first fabric 30 or comprised of a felted construction such as commonly used in a papermaking machine dryer section, which is looped about guide rolls 44, one or more of which are adjustably movable, as shown by arrows 45, to vary the tension.

Roll 48 is commonly known in the paper industry as a Yankee dryer and is usually between about 12 feet and about 18 feet in diameter. It functions by conducting heat into the web and water entrained therein through contact of web W with its surface 42. An air cap 50 is mounted above the upper peripheral surface of dryer 48 to direct heated air downwardly against the web W on the dryer surface to promote faster drying.

On the lower downstream side of dryer drum 48, a doctor 52 engages web W to remove it for transfer to reel 54 where it is wound into a roll 56. Guide rolls 58, 64 assist in this transfer.

In operation, the formed web W is picked off wire 12 by suction pickup roll 22 and carried on fabric 30 which holds it against the surface of transpiration dryer roll 34 and carries it to suction transfer roll 46 which urges the second fabric, or felt, 40 to pick it off fabric 30 and place it on the surface 42 of Yankee dryer drum 48 where it is carried to the point where it is doctored off and wound into a roll. The direction of rotation of dryers 34 and 48 are shown by arrows 66 and 67, respectively.

It is important to note that the web is not merely guided by a fabric/felt (i.e. placed in contact therewith), but it is carried (i.e. physically held on the fabric/felt or dryer roll surface by gravity or vacuum pressure) for its entire travel through the papermaking machine from pickup off the forming wire to where it is doctored off. Thus, there is no opportunity for the web to leave the surface of a fabric, felt or dryer and the chances of its breaking while being carried by these components are very low and certainly less than if it was adhering to the bottom or lower surface of a fabric, felt or dryer. This is especially important in the production of high bulk tissue which might broadly be defined as tissue which is not subjected to a pressing operation as it is passed through a papermaking machine during its production, at least prior to being dried. As such, the high bulk tissue remains very soft, delicate and susceptible to tearing so any situation requiring it to support itself from pickup through drying should be avoided, which is precisely what this invention achieves.

While the preferred embodiment has been described in detail, variations are contemplated. For example, the heated air supplied to transpiration dryer 34 could be supplied through its rotatable axles, in which case the bottom wall 39 of plenum 36 would be a continuous baffle instead of being foraminous. The transpiration dryer itself could comprise a flat, horizontal box over which the web carrying fabric would travel as shown in U.S. Pat. No. 3,447,247 which is assigned to the assignee of this invention. Also, first fabric 30 could carry the web W about more than one transpiration dryer 34, in which case Yankee dryer 48 might not be used, or Yankee dryer 48 might then be of a smaller diameter. Finally, the web W might be formed with a more traditional single wire Fourdrinier type arrangement.

What is claimed is:

1. In a papermaking machine for the manufacture of high bulk tissue web, having at least one forming wire, and web drying means comprising transpiration drying means which includes means supplying heated air and a foraminous surface through which the air is directed, the combination comprising:

a looped first fabric exposed in web receiving contact with the forming wire and arrayed (a) to carry the freshly formed web on the upper surface of the first fabric directly onto the foraminous surface of the transpiration drying means;

(b) to hold the web directly exposed to the foraminous surface so that the means supplying heated air passes it successively through the foraminous surface, the web, and the first fabric as the web is dried thereby; and (c) to carry the web from the transpiration drying means; and means for removing the web under positive control from the first fabric so that the web is carried during its entire passage from reception off the forming wire through the transpiration drying means and supported over, and in direct exposure with, the foraminous surface of the transpiration drying means.

2. The apparatus as set forth in claim 1, wherein:

the web drying means further includes a rotatable, cylindrical, dryer drum having a smooth, non-foraminous surface, positioned downstream of the transpiration drying means;

a looped second fabric disposed in web receiving contact with the first fabric; and the means for removing the web under positive control including web transferring means within the loop of the second fabric for (a) urging and carrying the web from the first fabric onto the second fabric and (b) transferring the web to the dryer drum smooth, non-foraminous surface at a low position thereon so that the web is carried upwardly and supported and dried on the surface thereof.

3. Apparatus for the manufacture of high bulk paper tissue web, comprising, in combination:

a former for supplying a dilute aqueous suspension of paper fibers;

at least one forming wire for receiving the aqueous suspension of fibers to form a tissue web thereon as the water drains away;

drying means, including (a) transpiration drying means comprising a rotatable cylinder having a foraminous peripheral surface and having means for introducing heated air interiorly thereof to be discharged radially outwardly successively through the foraminous surface, the web and a looped first fabric; and (b) a rotatable cylindrical dryer drum having a smooth, non-foraminous surface positioned downstream of the transpiration drying means;

said looped first fabric disposed in web receiving contact with the forming wire and arrayed to carry the web on the upper surface of the first fabric onto, around, and away from, the foraminous surface of the transpiration drying means while directly exposing the web thereto;

a looped second fabric arrayed in web receiving contact with the first fabric for receiving the web subsequent to its passage through the transpiration drying means;

web transferring means within the looped second fabric for (a) urging and carrying the web from the first fabric onto the second fabric; and (b) transferring the web to the dryer drum surface at a low position thereon so that the web is carried upwardly and supported and dried on the surface thereof; and means for removing the web from the dryer drum surface.

4. The apparatus as set forth in claim 3, further including:

a second wire forming a converging throat with the one wire for receiving the aqueous suspension of fibers therebetween whereby the web is formed as the water drains through both wires;

means for guiding one of the wires away from the newly formed web whereby the web is carried by the other wire; and web pickup means disposed within the looped first fabric in contact therewith for urging the web to transfer to the first fabric from the wire on which it is carried.

* * * * *